United States Patent [19]

Kane

[11] Patent Number: 4,956,574

[45] Date of Patent: Sep. 11, 1990

[54] SWITCHED ANODE FIELD EMISSION DEVICE

[75] Inventor: Robert C. Kane, Woodstock, Ill.

[73] Assignee: Motorola, Inc., Schaumburg, Ill.

[21] Appl. No.: 391,211

[22] Filed: Aug. 8, 1989

[51] Int. Cl.[5] ..... H01J 19/24; H01J 19/32; H01J 19/46

[52] U.S. Cl. ..... 313/306; 313/307; 313/308; 313/309; 313/336; 313/355; 445/51

[58] Field of Search ..... 313/306, 307, 308, 309, 313/336, 355; 445/50, 51

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,894,332 | 7/1975 | Nathanson et al. | 29/578 |
| 3,921,022 | 11/1975 | Levine | 313/309 |
| 3,970,887 | 7/1976 | Smith et al. | 313/309 |
| 3,998,678 | 12/1976 | Fukase et al. | 156/3 |
| 4,008,412 | 2/1977 | Yuito et al. | 313/309 |
| 4,178,531 | 12/1979 | Alig | 313/409 |
| 4,307,507 | 12/1981 | Gray et al. | 29/580 |
| 4,513,308 | 4/1985 | Greene et al. | 357/55 |
| 4,578,614 | 3/1986 | Gray et al. | 313/309 |
| 4,685,996 | 8/1987 | Busta et al. | 156/628 |
| 4,721,885 | 1/1988 | Brodie | 313/576 |
| 4,827,177 | 5/1989 | Lee et al. | 313/306 |
| 4,874,981 | 10/1989 | Spindt | 313/309 |

FOREIGN PATENT DOCUMENTS

| | | |
|---|---|---|
| 0172089 | 7/1985 | European Pat. Off. . |
| 2604823 | 10/1986 | France . |
| 855782 | 6/1977 | U.S.S.R. . |
| 2204991A | 11/1988 | United Kingdom . |

OTHER PUBLICATIONS

A Vacuum Field Effect Transistor Using Silicon Field Emitter Arrays, by Gary, 12/86 IEDM 86, pp. 776–779.

Advanced Technology: Flat Cold-Cathode CRTs, by Ivor Brodie, Information Display, 1/89, pp. 17–19.

Field-Emitter Arrays Applied to Vacuum Flourescent Display, by Spindt et al., Jan., 1989, issue of IEEE Transactions on Electronic Devices, pp. 225–228.

Field Emission Cathode Array Development for High--Current Density Applications by Spindt et al., dated Aug., 1982, vol. 16, of Applications of Surface Science, pp. 268–276.

*Primary Examiner*—Kenneth Wieder

*Attorney, Agent, or Firm*—Steven G. Parmelee

[57] ABSTRACT

A field emission device wherein two collecting electrodes are provided to selectively collect electrons that are emitted from an emitting electrode as induced by a gate electrode.

5 Claims, 1 Drawing Sheet

SWITCHED ANODE FIELD EMISSION DEVICE

TECHNICAL FIELD

This invention relates generally to field emission devices.

BACKGROUND ART

Field emission devices are known in the art. Such prior art devices are constructed in a vertical profile by means of complex deposition, etching, and evaporative metalization processes. Since the device elements are overlayed, the inter-element capacitances become significant and affect the performance of the device.

Typically, such prior art devices include a cathode, a gate to aid in controlling the emissions of the cathode, and an anode. Provision of only these three electrodes will not allow the resultant device to satisfactorily meet certain application needs.

There therefore exists a need for a field emission device that can be constructed in a simpler manner, that minimizes inter-element capacitance, and that meets applications needs not currently satisfied.

SUMMARY OF THE INVENTION

These needs and other needs are substantially met through provision of the planar field emission device disclosed herein. According to the invention, three electrodes of the device are disposed substantially coplanar with respect to one another, and not vertically. As a result, the device can be constructed in a simpler manner, and inter-element capacitance is minimized due to the improved proximity of the electrodes to a support surface. In addition, in one embodiment, the device includes a fourth electrode, which serves as a secondary anode. Electrons emitted by the cathode are collected by whichever of the two anodes are selectively engaged.

BEST MODE FOR CARRYING OUT THE INVENTION

Figure 1:
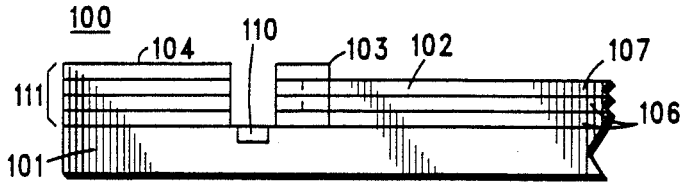
FIG. 1 comprises a side elevational view of the invention.
Figure 2:
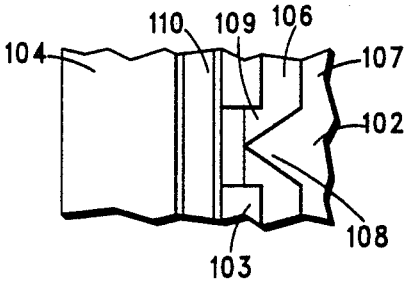
FIG. 2 comprises a top plan view of the invention.

Referring to FIG. 1, the invention can be seen as depicted generally by the numeral 100. The device includes generally a substrate (101), a first electrode (102), a second electrode (103), a third electrode (104), and a fourth electrode (110). The substrate should generally be comprised of an insulator (a conductor may be used, but the upper surface of the conductor should be coated with an insulating layer). The first electrode (102), in this embodiment, comprises an emitter. To form the emitter, multiple layers of insulating material (106) (in this case silicon dioxide) are deposited on the substrate (101) and a conductive layer (107) deposited thereon. With momentary reference to FIG. 2, the conductive layer (107) comprising the first electrode (102) has a pointed portion (108). This wedge shaped portion functions, when the device is operational, to source electrons as explained in more detail below.

The second electrode (103) forms a gate and is formed by successive depositions of conductive material. Importantly, as visible in FIG. 2, the second electrode (103) includes a notch (109) formed therein for receiving the pointed end (108) of the first electrode (102). The purpose of this configuration will be made more clear below.

Figure 3:
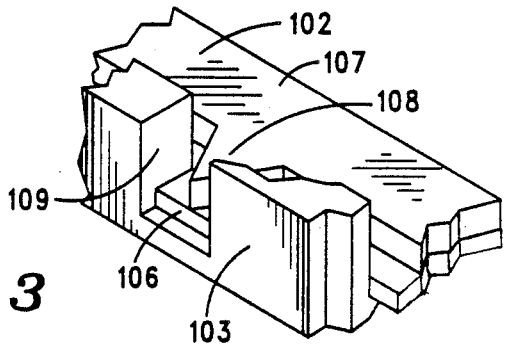
FIG. 3 comprises a perspective view of the invention.

The third electrode (104) comprises a first collector and is formed by successive depositions of conductive material (111) on the surface of the substrate (101). With reference to FIG. 3, it can be more clearly seen that the pointed tip (108) of the first electrode (102) is disposed within the notch area (109) formed in the gate (103). At the same time, the insulator (106) and the air gap ensures that the first electrode (102) does not contact the gate (103).

Lastly, the fourth electrode (110) comprises a second collector and is formed by deposition of conductive material within a notch formed in the substrate (101). (This notch can either be formed through an etching process, or the conductive material can be added during a substrate building material deposition process.)

So configured, appropriate field induced electron emission can be selectively achieved in at least two modes of operation. The required field is applied as a voltage to the gate (103) that is in sufficiently close proximity to the emitter (102) to induce electron emission. The emitted electrons are then transported from the emitter (102) to one of the collectors (104 and 110) in vacuum or atmosphere, as appropriate to the application. The dominant collector will be determined as a function primarily of the voltage applied thereto. In general, a somewhat stronger potential needs to be applied to the first collector (104) to compensate for the distance between the first collector (104) and the emitter (102). Conversely, a lesser voltage is required for the second collector (110) to achieve the same result.

Energization, and off-device coupling, of the two collectors (anodes) can be selected as appropriate to a particular application.

Figure 4:
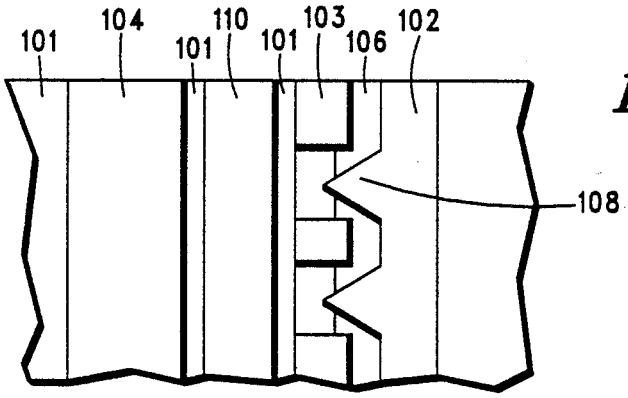
FIG. 4 comprises a top plan view of an alternative embodiment of the invention.

Referring to FIG. 4, it can be seen that a plurality of such three electrode devices can be formed on a substrate (101) in a parallel manner, to achieve improved power capabilities. In this embodiment, each device is formed substantially as described above, with the process replicated numerous times to achieve multiple parallel connected devices.

What is claimed is:

1. A field emission device, comprising:

(A) an emitter for emitting electrons;

(B) a first anode disposed substantially coplanar with respect to the emitter for collecting at least some of the electrons;

(C) a second anode for selectively collecting at least some of the electrons, such that when the second anode collects electrons, the first anode does not collect electrons.

2. The field emission device of claim 1, wherein the device further includes a gate that acts to induce electron emission from the emitter.

3. A field emission device, comprising:

(A) a substrate;

(B) emitter means formed on the substrate for emitting electrons;

(C) first anode means formed on the substrate and disposed substantially coplanar with respect to the emitter means for collecting at least some of the electrons;

(D) second anode means formed on the substrate for selectively collecting at least some of the electrons, such that when the second anode means collects electrons, the first anode means does not collect electrons.

4. The field emission device of claim 1, wherein the device further includes a gate that acts to induce electron emission from the emitter.

5. A method of forming a field emission device, comprising:

(A) providing a substrate;

(B) forming a first electrode on the substrate, which first electrode acts as an electron source;

(C) forming a second electrode on the substrate substantially co-planar with the first electrode, which second electrode acts to induce electron emission from the first electrode;

(D) forming a third electrode on the substrate substantially co-planar with the first electrode, which third electrode acts to collect at least some of the electrons sourced by the first electrode;

(E) forming a fourth electrode on the substrate, which fourth electrode acts to collect at least some of the electrons sourced by the first electrode, such that when the fourth electrode collects electrons, the third electrode does not collect electrons.

* * * * *